US006742985B2

(12) United States Patent
Matyscak et al.

(10) Patent No.: US 6,742,985 B2
(45) Date of Patent: Jun. 1, 2004

(54) THERMAL TURBOMACHINE, AXIAL FLOW GAS TURBINE IN PARTICULAR

(75) Inventors: Kamil Matyscak, Brenden Uehlingen-Birkendorf (DE); Pierre Meylan, Magglingen-Macolin (CH); Michael Mueller, Ulm (DE)

(73) Assignee: Alstom Technology Ltd, Baden (CH)

( * ) Notice: Subject to any disclaimer, the term of this patent is extended or adjusted under 35 U.S.C. 154(b) by 0 days.

(21) Appl. No.: 10/379,687

(22) Filed: Mar. 6, 2003

(65) Prior Publication Data

US 2003/0170118 A1 Sep. 11, 2003

(30) Foreign Application Priority Data

Mar. 7, 2002 (DE) ..... 102 10 174

(51) Int. Cl.[7] ..... F01D 25/16
(52) U.S. Cl. ..... 415/142; 415/229; 415/135
(58) Field of Search ..... 415/135, 142, 415/229; 416/244 R

(56) References Cited

U.S. PATENT DOCUMENTS 3,804,475 A 4/1974 Brücher et al. ..... 308/122
4,076,452 A * 2/1978 Hartmann ..... 60/797
4,331,366 A 5/1982 Dömer et al. ..... 308/22
5,094,588 A 3/1992 Gros ..... 415/213.1
5,108,258 A * 4/1992 Gros ..... 415/213.1
5,326,222 A * 7/1994 Matyscak et al. ..... 415/213.1

FOREIGN PATENT DOCUMENTS

DE 198 42 811 A1 7/1999
EP 0 491 966 A1 12/1990 ..... F01D/25/16

OTHER PUBLICATIONS

German Search Report for German Application No. 102 10 174.4, dated Aug. 28, 2002.
European Search Report filed Jul. 21, 2003.

* cited by examiner

*Primary Examiner*—Ninh H. Nguyen
(74) *Attorney, Agent, or Firm*—Adam J. Cermak

(57) ABSTRACT

A thermal turbomachine, an axial flow gas turbine (10) in particular, includes a rotor (16), which at its exit side is supported on a bearing (15), which is situated on a bearing saddle (14) within an annular inner part (11) of an exhaust casing, the bearing saddle (14) being supported on a foundation of the machine by means of a spring support (25). In such a turbomachine, the stiffness of the bearing support is improved or restored by attaching the bearing saddle (14) to the inner part (11) of the exhaust casing by a spring-loaded bolted connection (19, . . . .,22).

5 Claims, 1 Drawing Sheet

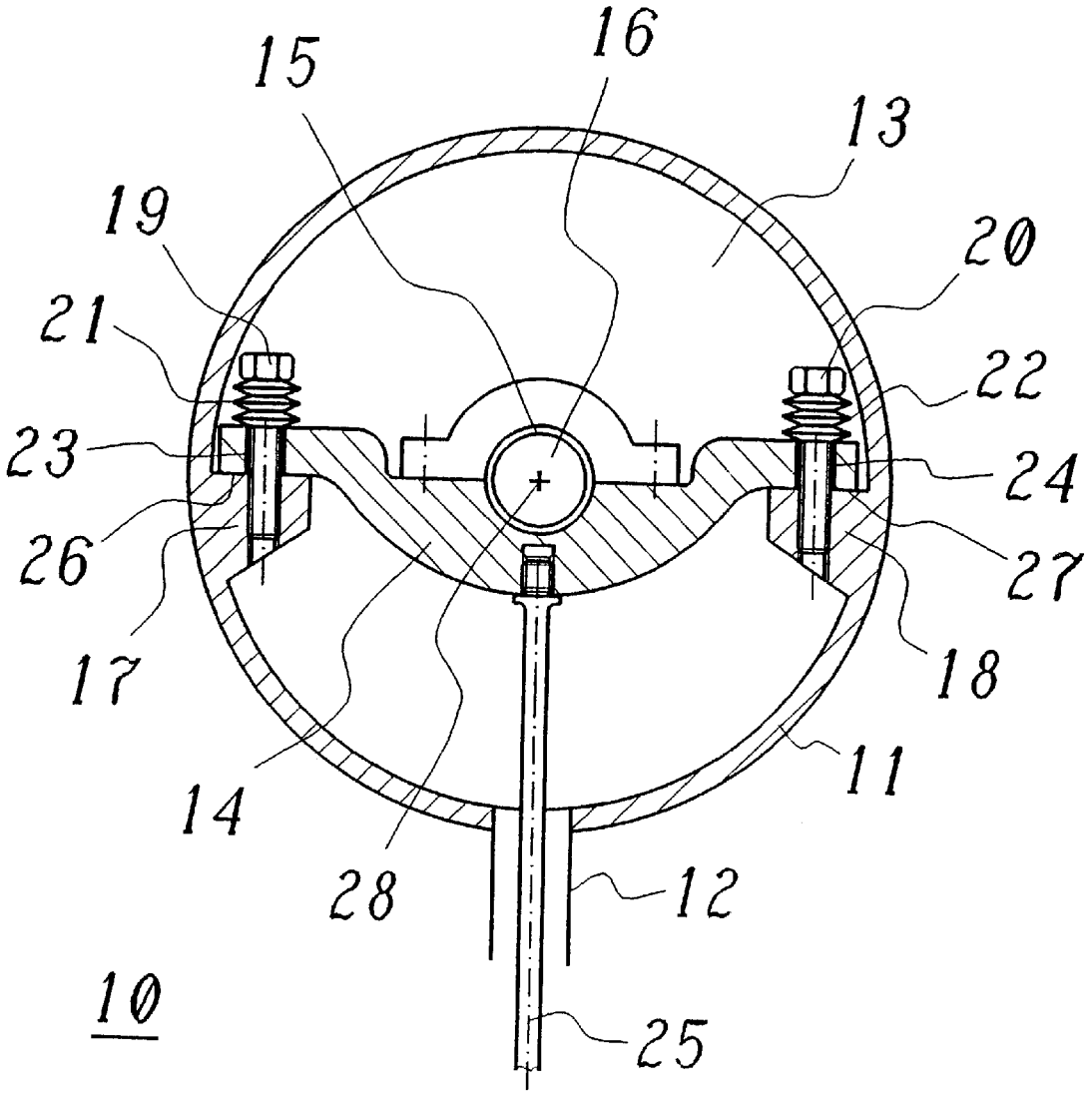
15
16
13
19
20
21
22
23
24
26
27
17
18
14
11
28
12
10
25

THERMAL TURBOMACHINE, AXIAL FLOW GAS TURBINE IN PARTICULAR

This application claims priority under 35 U.S.C. §119 to German application number 102 10 174.4, filed Mar. 7, 2002, the entire contents of which are incorporated by reference herein.

FIELD OF TECHNOLOGY

The present invention relates to the field of technology of thermal turbomachines. It concerns in particular a thermal turbomachine according to the preamble of claim 1.

Such a machine and its exit-side rotor support in particular are known from publication EP-A1-0 491 966, the entire contents of which are incorporated by reference herein.

BACKGROUND OF THE INVENTION

The bearing support of an axial flow gas turbine is described and shown in the aforementioned publication. In this gas turbine, an exhaust casing adjoins its exit-side rotor blades, the boundary walls of the exhaust casing being primarily made up of an annular inner part on the hub side and an annular outer part concentrically surrounding the annular inner part. The boundary walls delimit and form a diffuser. The exit-side bearing support of the rotor of the gas turbine is situated in the cavity of the inner part, the bearing support including a bearing accommodated in a bearing housing. In order to make the support of the exit-side bearing support independent of the influences of thermal load and thermal expansion of the housing and the diffuser walls, the position of the bearing housing may be adjusted using adjusting elements situated on the inner part of the exhaust casing and supported via at least one spring support on the foundation of the machine. The spring support includes one bar, which leads out of the hot diffuser area to the foundation.

A disadvantage in this known arrangement is that the vertical support of the exit-side bearing support is far too elastic for a bearing support of a turbomachine.

SUMMARY OF THE INVENTION

It is therefore the objective of the invention to devise a turbomachine having an exhaust gas-side bearing support, which has significantly increased stiffness compared to the known bearing support without giving up the advantages attained through the spring support.

This objective is realized with the entirety of features of claim 1. The core concept of the invention is to provide a spring-loaded bolted connection which restores a stiff connection with the bearing star (due to the pressure of the bolt springs).

A first embodiment of the turbomachine according to the invention, which is preferred in particular owing to its simplicity, is characterized in that the bearing saddle in a horizontal dividing plane is a separable part of a bearing star situated in the inner part of the exhaust casing and that the spring-loaded bolted connection is situated in the dividing plane.

Particularly advantageous circumstances result for the bearing support of the present invention if the spring-loaded bolted connection includes bolt springs, which in aggregate are designed for a force of the same order of magnitude as the spring supports.

In order to reliably avoid moment loads in an incident of unbalance, it is advantageous if according to another embodiment of the invention, the junction points of the bearing star with the inner part of the exhaust casing are positioned symmetrical to the bearing center.

BRIEF DESCRIPTION OF THE FIGURES

The invention is explained below with the help of embodiments in reference to the drawing. In conformity with FIG. 2 of EP-A1-0 491 966, the only figure shows a preferred exemplary embodiment of a turbomachine according to the present invention in a cross-section through the inner part of the exhaust casing.

DETAILED DESCRIPTION OF EMBODIMENTS OF THE INVENTION

The FIGURE shows a section of the cross-section through the exit-side bearing support of a gas turbine 10 limited to the inner part according to a preferred embodiment of the invention. In principle, the position of inner part 11 of the exhaust casing within gas turbine 10 may be obtained from FIG. 1 of EP-A1-0 491 966.

The exit-side bearing 15 for rotor 16 of gas turbine 10 is situated in interior chamber 13 of inner part 11. Bearing 15 is supported by a horizontal bearing saddle 14 which is [situated] along a dividing plane (contact surfaces 26, 27) of a separable part of a bearing star 17, 18. Bearing saddle 14 is joined to the other elements of bearing star 17, 18 by a spring-loaded bolted connection 19, 20, 21, 22, which includes the corresponding threaded bolts and bolt springs 21, 22. The spring-loaded bolted connection 19, . . . ,22 is preferably provided in the horizontal dividing plane. The threaded bolts pass through through bores 23, 24 with adequate play, the through bores being provided on both sides of bearing saddle 14. At the same time, bearing saddle 14 is supported against the machine foundation by a spring support 25, which is led downwards out of inner part 11 as described and shown in EP-A1-0 491 966. Outside of inner part 11, spring support 25 is enclosed by a support casing ("strut casing").

The spring-loaded bolted connection 19, . . . ,22 within bearing star 17, 18 restores the stiffness of the bearing support impaired by spring support 25. Normally, bearing saddle 14 is located movably on contact surfaces 26, 27 of bearing star 17, 18, since the latter is exposed to greater thermal expansions. In the case of a design without spring support, the entire own weight of rotor 16 and bearing saddle 14 would be transferred via contact surfaces 26, 27 of the support. According to earlier experience, this weight load causes sufficient stiffness of the support, which is now partly or completely eliminated by the spring support (25). In a design with spring support according to the invention, spring-loaded bolted connection 19, . . . ,22 now replaces the (lacing) weight load on contact surfaces 26, 27 without adversely affecting the relaxation of the continuous load on the bearing star structure. Bolt springs 21, 22 are preferably designed in aggregate for a force in the same order of magnitude as that of spring support 25.

In order to reliably avoid moment loads in an incident of unbalance, it is further advantageous if the junction points of bearing star 17, 18 with inner part 11 of the exhaust casing are preferably positioned symmetrical to bearing center 28 of bearing 15.

| LIST OF REFERENCE NUMERALS | |
|---|---|
| 10 | Gas turbine |
| 11 | Inner part (exhaust casing) |
| 12 | Support casing |
| 13 | Interior chamber |
| 14 | Bearing saddle |
| 15 | Bearing |
| 16 | Rotor |
| 17, 18 | Bearing star |
| 19, 20 | Bolted connection |
| 21, 22 | Bolt spring |
| 23, 24 | Through bore |
| 25 | Spring support |
| 26, 27 | Contact surface (dividing plane) |
| 28 | Bearing Center |

We claim:

1. A thermal turbomachine comprising:

a rotor, a bearing, a bearing saddle, an exhaust casing having an annular inner part, a foundation, a spring support, and a spring-loaded bolted connection, the rotor having an exit side at which the rotor is supported on the bearing, the bearing being situated on the bearing saddle within the annular inner part of the exhaust casing, the bearing saddle being supported on the foundation by the spring support, the bearing saddle being affixed to the inner part of the exhaust casing by the spring-loaded bolted connection.

2. A turbomachine according to claim 1, further comprising a bearing star, and wherein the bearing saddle in a horizontal dividing plane comprises a separable part of the bearing star, the bearing star being situated in the inner part of the exhaust casing and the spring-loaded bolted connection being situated in the dividing plane.

3. A turbomachine according to claim 1, wherein the spring-loaded bolted connection comprises bolt springs which in aggregate are designed for a force of the same order of magnitude as the spring support.

4. A turbomachine according to claim 2, further comprising junction points of the bearing star with the inner part of the exhaust casing positioned symmetrical to the bearing center of the bearing.

5. A turbomachine according to claim 1, wherein the turbomachine comprises an axial flow gas turbine.

* * * * *